United States Patent [19]

Ganz

[11] Patent Number: 4,633,647

[45] Date of Patent: Jan. 6, 1987

[54] WRAP FOR ARTICLE CLUSTERS AND APPARATUS FOR AND METHOD OF APPLYING SAME

[75] Inventor: Robert H. Ganz, Saddle River, N.J.

[73] Assignee: The Mead Packaging Corporation, Dayton, Ohio

[21] Appl. No.: 709,724

[22] Filed: Mar. 8, 1985

[51] Int. Cl.[4] ..... B65B 21/24

[52] U.S. Cl. ..... 53/398; 53/462; 53/48; 53/233

[58] Field of Search ..... 53/398, 399, 462, 466, 53/48, 233

[56] References Cited

U.S. PATENT DOCUMENTS

| | | | |
|---|---|---|---|
| Re. 28,535 | 9/1975 | Ganz | 53/398 |
| 2,882,665 | 4/1959 | Cross | 53/233 |
| 3,220,160 | 11/1965 | Roberts | 53/233 |
| 4,083,163 | 4/1978 | Ganz | 53/48 |

*Primary Examiner*—Horace M. Culver

*Attorney, Agent, or Firm*—Charles E. Brown; Charles A. Brown

[57] ABSTRACT

This relates to the forming of shrink wrap packages. A continuous web predivided into wrap sections is delivered to moving article clusters and is drawn thereabout by a puller apparatus while article clusters are supported on a moving conveyor having openings therethrough at regularly spaced intervals. The article clusters are retarded relative to the conveyor so that the conveyor advances relative to the article clusters. The web is precut to define the individual wraps and the conveyor has adjacent each opening fingers for interlocking with the web to draw the web over a trailing article cluster. The wrap web is eventually clamped to the article cluster and as the conveyor continues to advance causes separation of the leading wrap section from the remainder of the web. The conveyor then moves a trailing flap under the article cluster and a forward flap is later moved under the article cluster and the trailing flap by discharge rollers.

20 Claims, 13 Drawing Figures

134
93
106
116
97
108
98
100
110
94
104
96
114
102
112
116
20
92
90
22
34
62
48
52
A
36
150

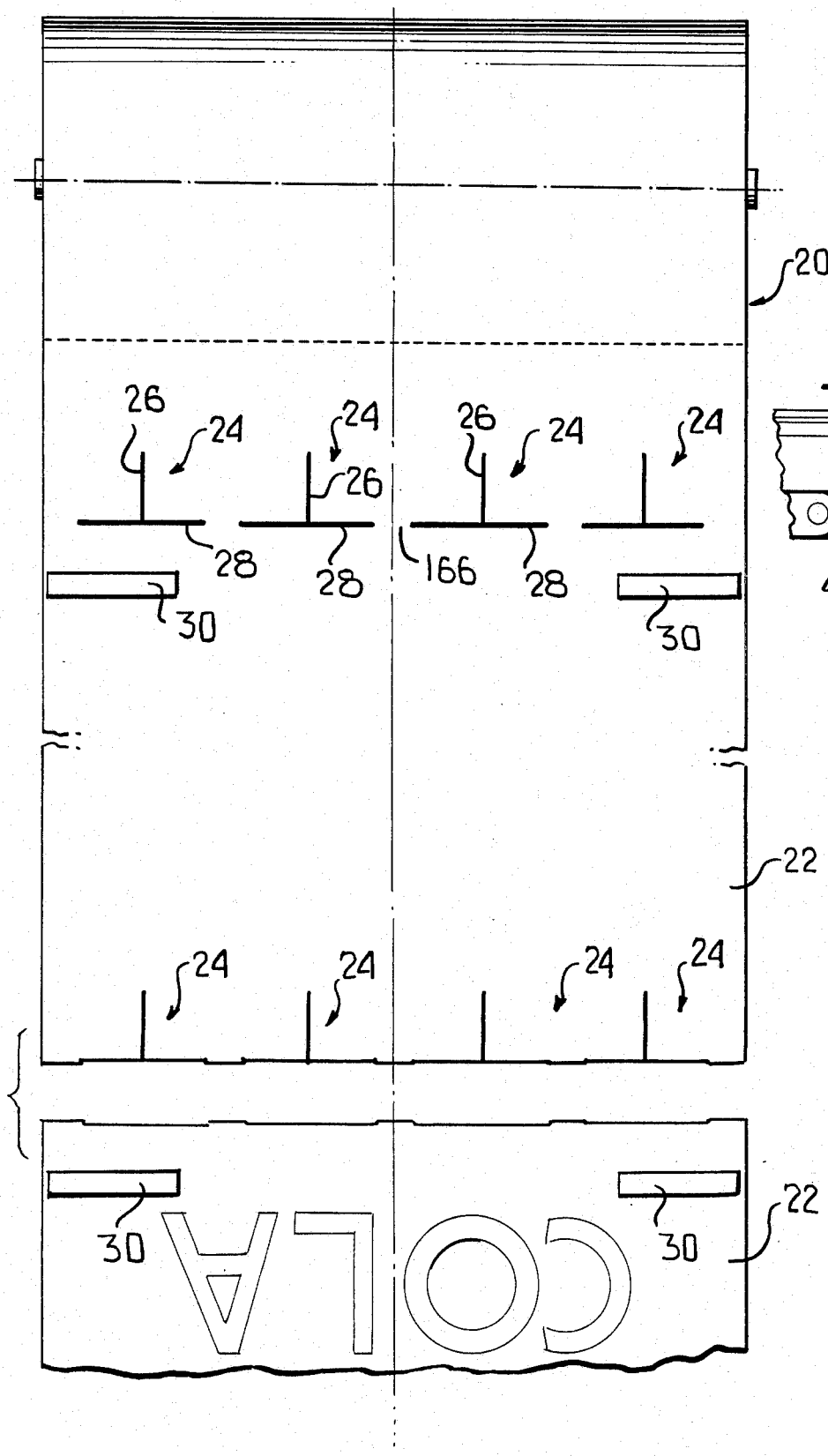
FIG.7
FIG.8
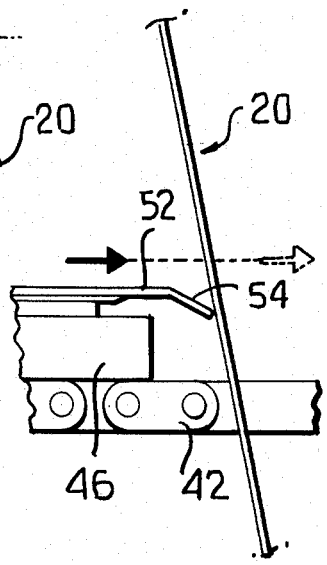
FIG.9
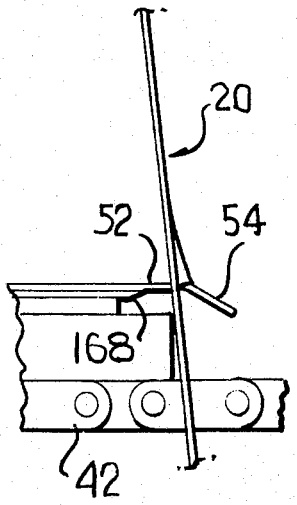
FIG.10
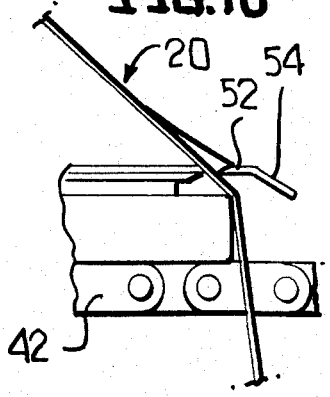

WRAP FOR ARTICLE CLUSTERS AND APPARATUS FOR AND METHOD OF APPLYING SAME

This invention relates in general to new and useful improvements in the formation of packages by providing clusters of articles, and encasing the articles in a wrap, such as a shrink wrap. Most particularly, the invention relates to an apparatus wherein a preprinted wrap member may be applied to an article cluster.

It is well known to form packages of article clusters by placing around each article cluster a wrap. However, the wraps are normally in the form of plain unprinted webs. Accordingly, it is one of the features of the invention to be able to apply printed wrap members to article clusters in the formation of packages therefrom.

Another feature of the invention is the provision of an elongated wrap which may be readily separated into individual wrap members.

Yet another feature of the invention is the provision of an apparatus which will receive an elongated wrap, apply the wrap to individual article clusters, and in applying the wrap to article cluster, separating the wrap into wrap members with there being one wrap member for each article cluster to be wrapped.

A particular feature of the invention is to provide an apparatus which includes a conveyor for conveying a plurality of article clusters in spaced relation from an article cluster receiving area to an article cluster discharge area wherein the conveyor is divided into segments by longitudinally spaced transverse openings in the conveyor with each conveyor segment being intended to receive one article cluster and wherein in the utilization of such conveyor each article cluster is retarded against movement with the conveyor at the same speed as the conveyor and wherein a portion of the wrap is drawn through each opening in the conveyor and thereafter grasped by the conveyor to first draw the wrap relative to a trailing article cluster and then to effect transverse rupture of the wrap to divide the wrap into individual wrap members. Further, by having the conveyor move relative to and under the article clusters, the trailing end portion of each wrap member may be moved by the conveyor beneath the associated article cluster.

Another feature of the invention is to provide a novel wrap wherein the wrap is provided at regular intervals, in accordance with the length of the wrap required to wrap an article cluster with transversely aligned openings into which may be engaged fingers carried by the conveyor at the trailing edge of each conveyor opening so as to draw and stretch the wrap, and wherein the openings are transversely aligned and have portions adjacent one another which may be ruptured so as to effect the separation of the wrap into individual wrap members.

The invention also relates to the method of utilizing the wrap so as to automatically apply the wrap to article clusters carried by the conveyor.

With the above and other objects in view that will hereinafter appear, the nature of the invention will be more clearly understood by reference to the following detailed description, the appended claims, and the several views illustrated in the accompanying drawings.

FIG. 2 is an enlarged fragmentary schematic view of that portion of the apparatus of FIG. 1 wherein a portion of the wrap has just been drawn through.

FIG. 7 is a plan view, with parts broken away, of a preferred embodiment of the wrap and shows a lead position thereof separated from the remainder of the wrap.

FIGS. 8, 9 and 10 are schematic elevational views showing the manner in which fingers on the conveyors are engaged in openings in the wrap and then draw the wrap as the conveyor advances.

Figure 1:
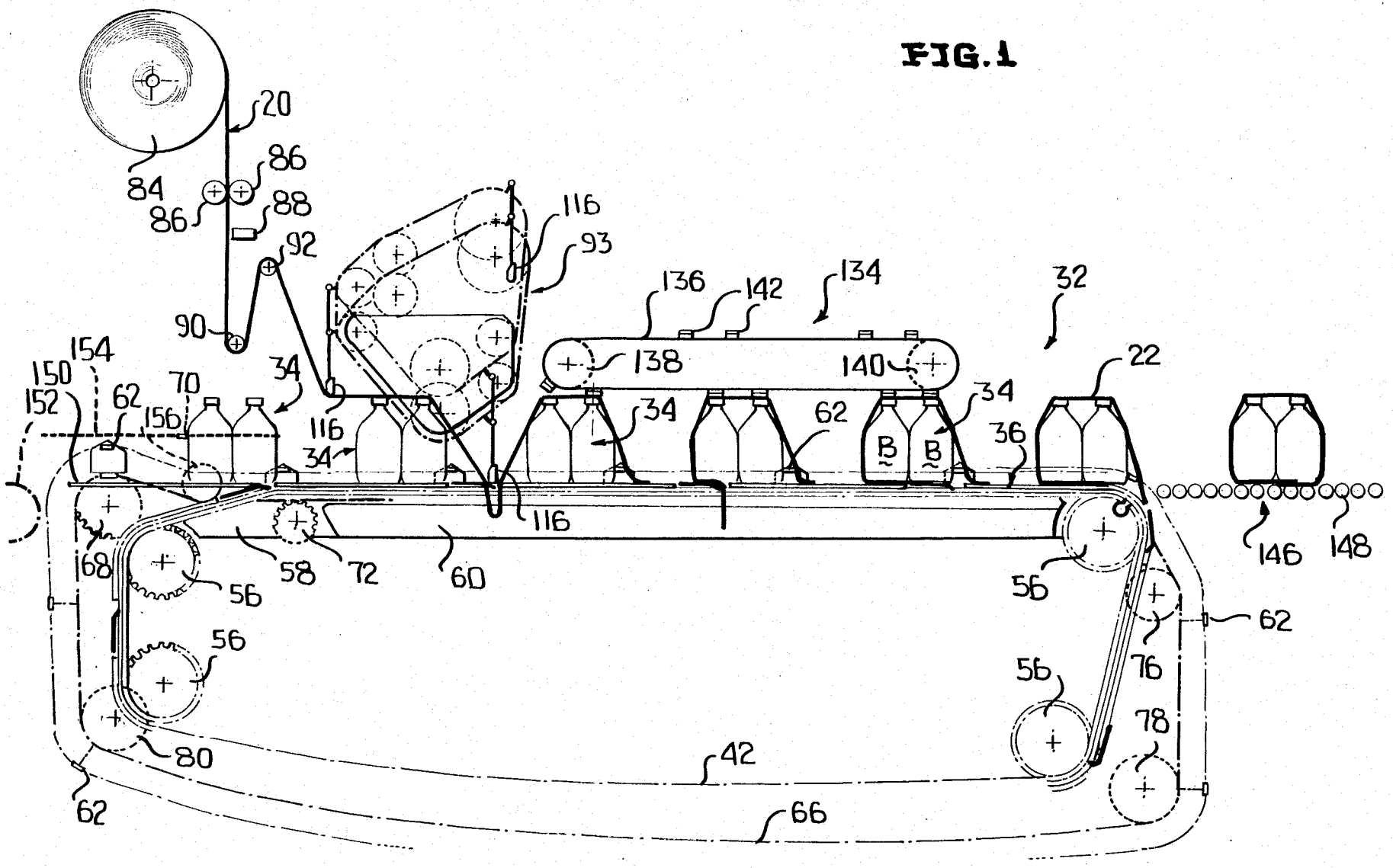
FIG. 1 is a schematic side elevational view of the apparatus for applying the wrap to article clusters and shows the general details thereof.

Referring now to the drawings in detail, reference is first made to FIG. 7 where there is illustrated the web which is to be applied in the wrapping of article clusters, the web being generally identified by the numeral 20. The web 20, in the primarily intended usage of the invention, is in the form of a shrink wrap film. However, it is to be understood that the wrap may be of other conventional wrap forming materials particularly those having a limited degree of longitudinal stretch for registration purposes as will be described in detail hereinafter.

The wrap 20 is provided in reel or roll form and has been previously divided into a plurality of individual wrap members or segments 22. It is to be understood that the manner in which the wrap 20 is divided into wrap members forms a material part of this invention.

As is clearly shown in FIG. 7, at regularly spaced intervals, the wrap 20 is provided with a plurality of transversely aligned T-shaped cuts 24 which are inverted in the illustration of FIG. 7. Each cut 24 includes a stem 26 and a cross bar 28. The stems 26 extend longitudinally of the wrap 20 while the cross bars 28 extend transversely of the wrap 20.

While the word "cut" has been utilized with respect to the stem 26 and the cross bar 28, and this is the preferred embodiment, it is to be understood that each of these portions could be in the form of an interrupted cut line or in the form of a weakening line (score) or a combination of the two. The whole purpose of the cuts 24 is to provide openings in the wrap 20 as will be described hereinafter.

At this time it is to be noted that the cross bars 28 are in alignment transversely of the wrap 20 but are spaced from one another. However, the spacing of ends of adjacent cross bars 28 from one another and from the side edges of the wrap 20 will be such that when the wrap 20 is properly tensioned, it will rupture transversely of its length and be automatically divided into a plurality of the previously identified wrap members or sections 22.

In a preferred embodiment of the invention, each wrap member 22 is provided with suitable indicia which will be printed on the wrap at the same time the T-shaped cuts 24 are formed therein. Further, there will be printed on the wrap a position detecting stripe 30 which may be sensed and wherein the feeding of the wrap 20 may be advanced or retarded so as to maintain alignment of each wrap member 22 with a respective article cluster to be packaged.

It will be seen at the lower part of FIG. 7 that a previously advanced wrap member 22 has been separated from the remainder of the wrap 20 by tensioning the wrap and tearing the same between the ends of the cross bar cuts 28.

Referring now to FIG. 1, it will be seen that there is generally illustrated the apparatus for applying the wrap 20 to article clusters, the apparatus being generally identified by the numeral 32. First of all, it will be seen that the illustrated article clusters which are being wrapped are identified by the numeral 34 and are each in the form of a plurality of bottles B arranged in two columns extending transversely of the apparatus. The bottles B are arranged in rows longitudinally of the apparatus and there may be a preselected number of bottles in each of the columns. However, the term "article cluster" is not intended to be so limited either as to the articles or the number and arrangement of articles. For example, it is feasible that each article cluster be composed of but a single article. On the other hand, the articles may be cans, boxes, etc. which will be packaged in the normal manner to which this invention relates.

Figure 6:
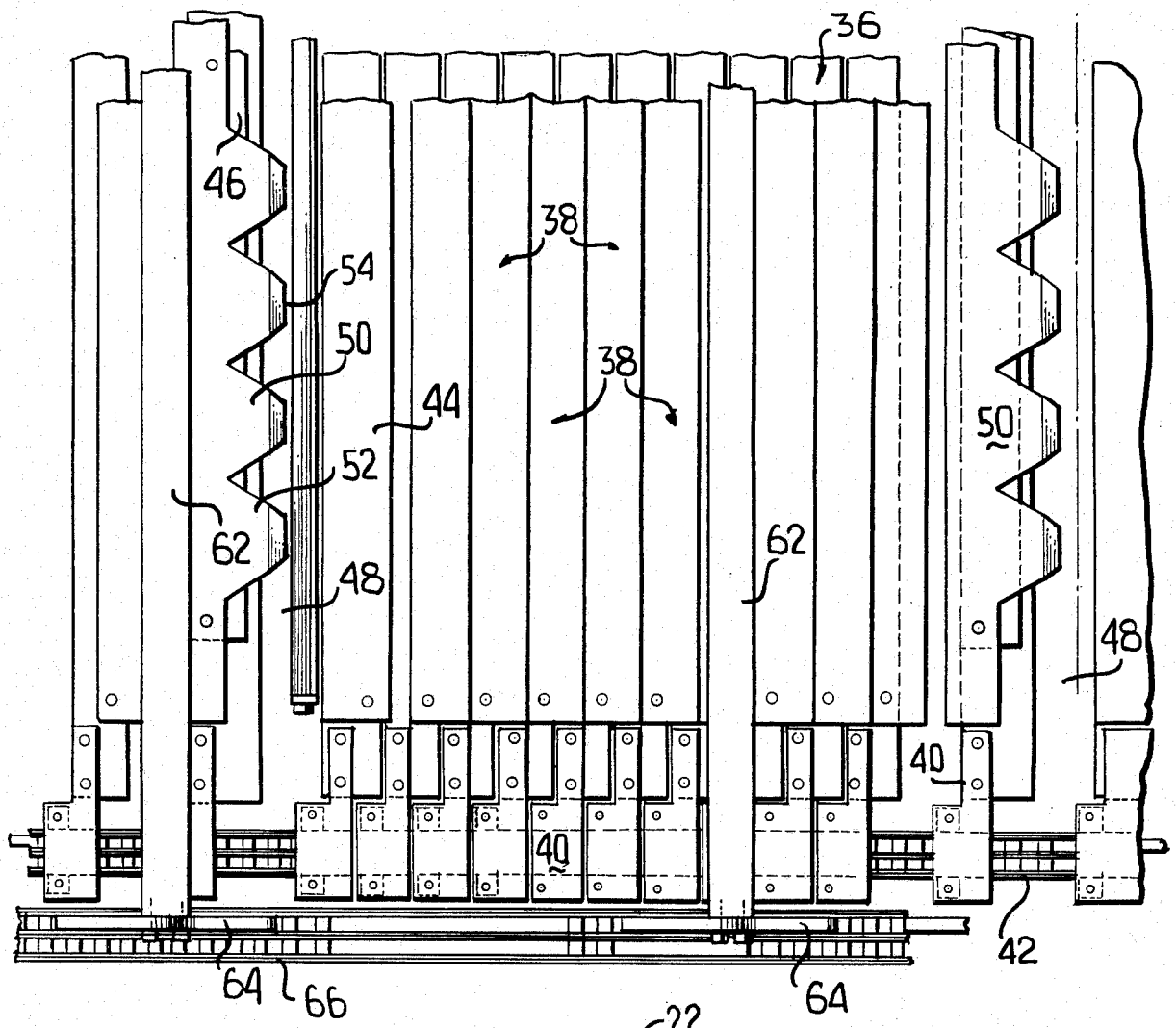
FIG. 6 is an enlarged fragmentary plan view of the apparatus and shows generally the details of the conveyor, the retarder and the wrap draw bar in the position of FIG. 4.

The apparatus 32 includes an endless conveyor which is generally identified by the numeral 36 and which, as is best illustrated in FIG. 6, is formed by a plurality of flat bars 38 which have the ends thereof carried by carriers 40 which, in turn, are carried by suitable supporting chains 42. While the invention will be described as though the bars 38 are of a length to receive but one row of article clusters 34, it is to be understood that the bars 38 may be of a length to receive two or more transversely adjacent article clusters and instead of there being chains 42 only at the remote ends of bars 38 which extend entirely across the apparatus, the bars 38 may extend only partially across the width of the apparatus and there may be intermediate chains 42 and intermediate carriers 40.

It is to be understood that in addition to the bars 38, the conveyor 36 will include at regular intervals a trailing bar 44 and a leading bar 46 which are spaced from one another to define therebetween at regular intervals an opening 48. The openings 48, which extend transversely of the apparatus, divide the conveyor 36 into sections, each of which is intended to receive an article cluster 34.

Further, each bar 46 carries at the trailing end of the respective opening 48 a combined finger and cutter 50. The bar 50 is provided with a plurality which taper in width rearwardly and have forwardly projecting starter portions 54.

The provision of the T-shaped cuts 24 in the wrap 20 has been previously described.

It is to be understood that the chains 42 will be driven by a common set of sprockets, such as the sprockets 56 illustrated in FIG. 1. It is also to be understood that the upper rungs of the chains 42 will be supported by suitable support bars, such as the support bars 58 and 60 shown in FIG. 1.

The apparatus also includes retarder means in the form of a plurality of retarder bars 62 which extend transversely of the conveyor 36 and in overlying relation to the conveyor 36. The retarders 62 are in the form of bars which are carried by support arms or carriers 64 which, in turn, are carried by chains 66. It is to be noted that the retarders 62 are spaced above the surface of the conveyor 36 and are spaced at a lesser interval than are the openings 48.

At this time it is pointed out that the retarder chains 66 are driven in unison with the conveyor chains 42, but at a lesser rate. In actuality, the speed of the retarder chains 66 as compared to the speed of the conveyor chains 42 is in the same ratio as the spacing of the retarders 62 to the spacing of the openings 48. Thus, the conveyor 36 advances at a much higher rate than the retarders 62. Since the retarders 62 engage the article clusters 34 and limit their movement with the conveyor 36, it will be seen that the conveyor 36 must slide beneath the article clusters 34. To this end, the various bars of the conveyor 36 are preferably formed of plastic or plastic coated metal.

The retarder chains 66 pass over a plurality of sprockets which are shown for identification purposes in FIG. 1 in phantom lines. These sprockets include, starting at the upper left corner of the apparatus of FIG. 1 sprockets 68, 70, 72, 74, 76, 78 and 80. The upper rung of the retarder chains 66 is supported by suitable support bars such as the support bars 82 shown in FIG. 5.

Referring once again to FIG. 1, it will be seen that the web 20 is provided in the form of a roll 84 which is suitably mounted at an overhead position for paying out the web 20. The web 20 is drawn from the roll 84 by means of a pair of driven rolls 86, 86, which are driven at varied speeds in a conventional manner. Below the rolls 86, 86 is a conventional sensor 88 which senses the position detecting stripe 30 in timed relation to the operation of the apparatus to make certain that the individual wraps 22 are aligned with the article clusters. The sensor 88 will control the operation of the rolls 86, 86.

The web 20 passes down around a lower roll 90 and then up and over an upper roll 92 and then generally towards the conveyor.

As will be described in detail hereinafter, the wrap web 20, after being fed by the rolls 86, 86 is engaged by the fingers 52 and drawn forward over the following article cluster. The web 20, between adjacent article clusters, is engaged by a puller assembly generally identified by the numeral 93 and drawn down between adjacent article clusters and through the opening 48.

Figure 2:
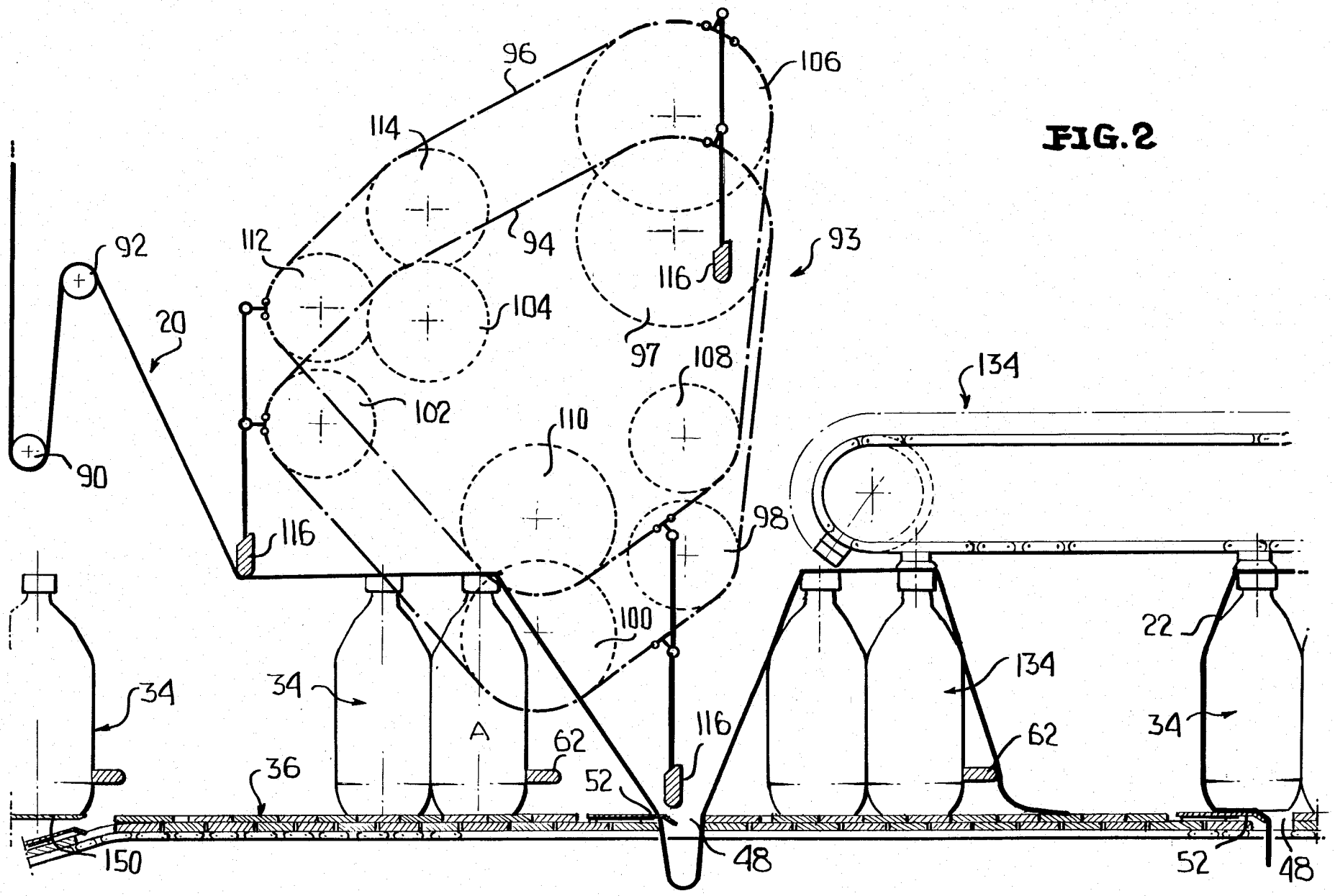
Figure 3:
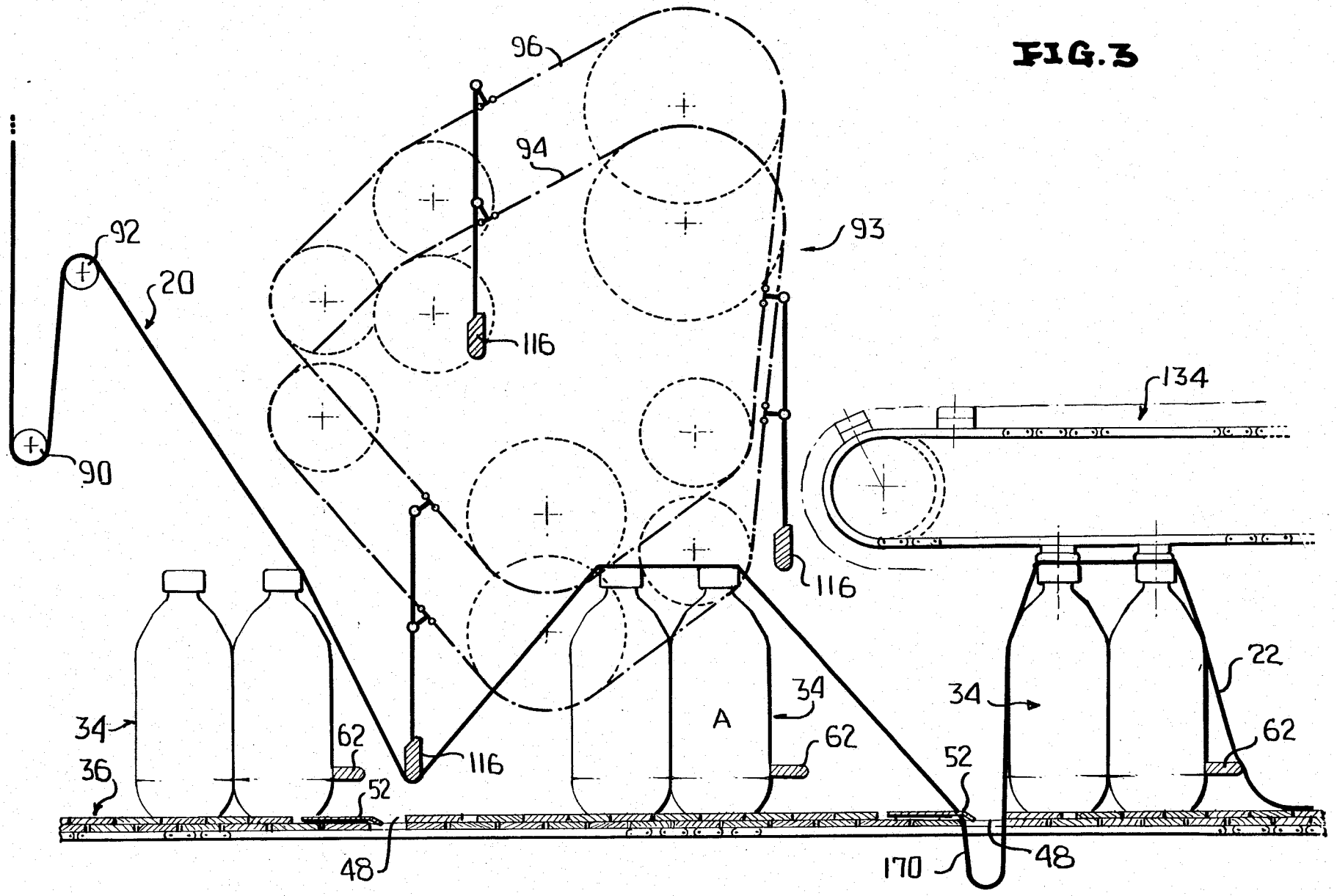
FIG. 3 is a enlarged fragmentary side elevational view of the apparatus of FIG. 1 showing the wrap as it is being drawn forward by the conveyor and at the same time wherein a portion thereof is being drawn down towards an associated conveyor opening.
Figure 5:
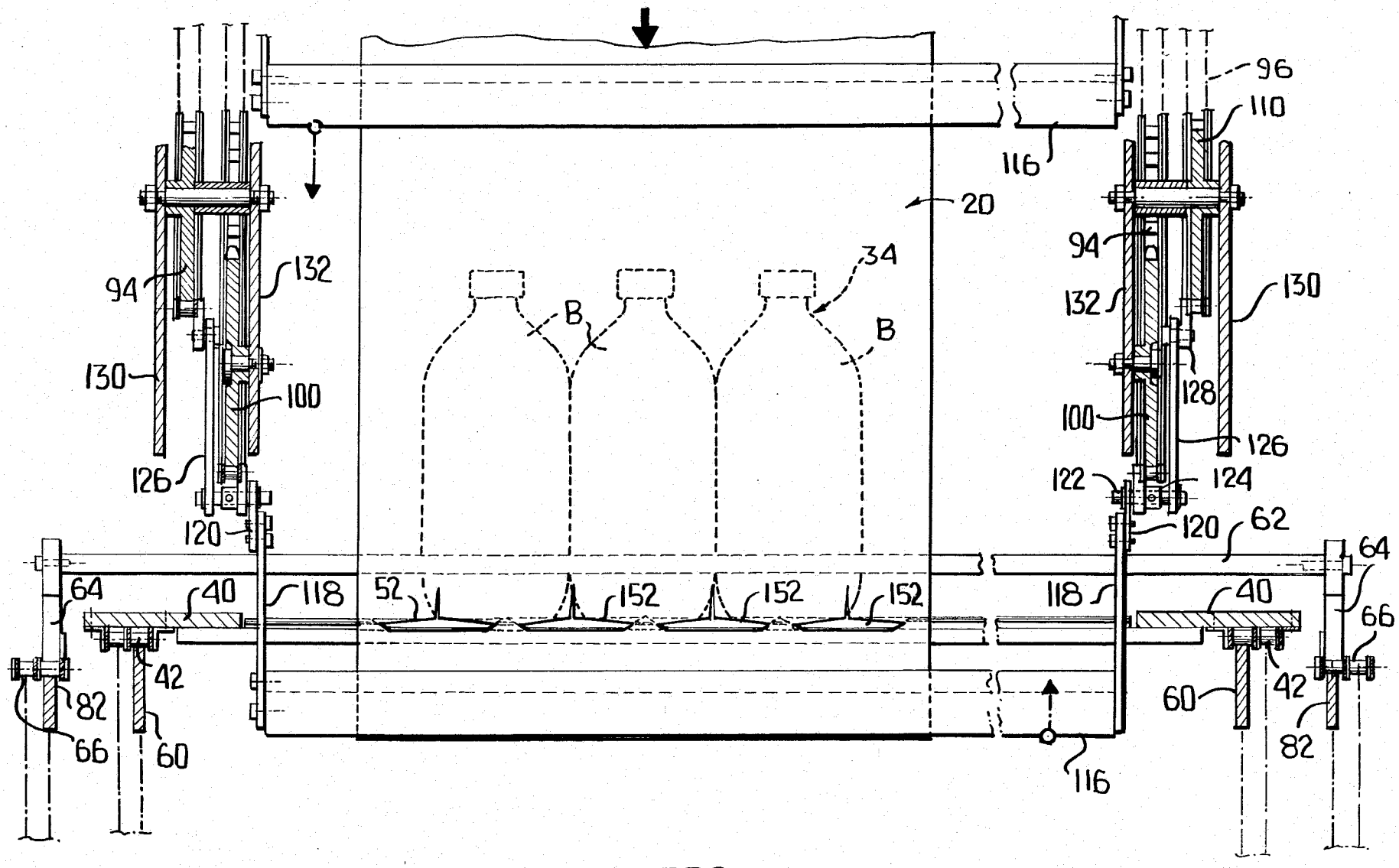
FIG. 5 is an enlarged fragmentary transverse sectional view taken generally along the line 5—5 of FIG. 4 and shows generally the constructional details of the apparatus.

Referring now to FIG. 2 in particular and with reference also to FIG. 5, it will be seen that the puller assembly 93 includes a pair of lower chains 94 which are spaced transversely of the apparatus and a pair of upper chains 96 which are also spaced transversely of the apparatus. It will be seen that each of the chains 94 passes over a plurality of sprockets with the chain 94 being carried by an uppermost drive sprocket 97, an intermediate sprocket 98, a lowermost sprocket 100, an intermediate sprocket 102 and an upper guide sprocket 104. The sprockets for the chains 96 are identical to the sprockets for the chain 94, but are vertically offset therefrom. These sprockets include an upper drive sprocket 106, an intermediate sprocket 108, a lowermost sprocket 110, an intermediate sprocket 112 and an upper guide sprocket 114.

It is to be understood that the chains 94, 96 move in a counterclockwise direction and the principal sprockets are the sprockets 102, 112; 106, 110 and 98, 108 which control first the downward movement of puller bars 116 and the upward movement thereof.

The puller assembly 93 includes three of the puller bars 116 which are equally spaced from one another. Each puller bar 116 is carried by a vertically disposed carrier 118 which is secured to an end of the puller bar, as is best shown in FIG. 5. The carrier 118 is rigidly secured to an arm 120 which is carried by a connected member 122 which, in turn, is carried by the chain 94 by way of a fitting 124. The connector 122 is carried by a link 126 remote from the arm 120. The upper end of the link 126 is carried by a fitting 128 carried by the chain 96.

At this time it is pointed out that the puller assembly 93 is carried by support plates 130 and 132 with the sprockets being mounted therebetween.

Downstream of the puller assembly 93 is a hold-down conveyor, generally identified by the numeral 134. The conveyor 134 includes a pair of parallel chains 136 which are mounted on a pair of sprockets 138, 140. One of the sprockets is driven in unison with the remainder of the apparatus.

Figure 4:
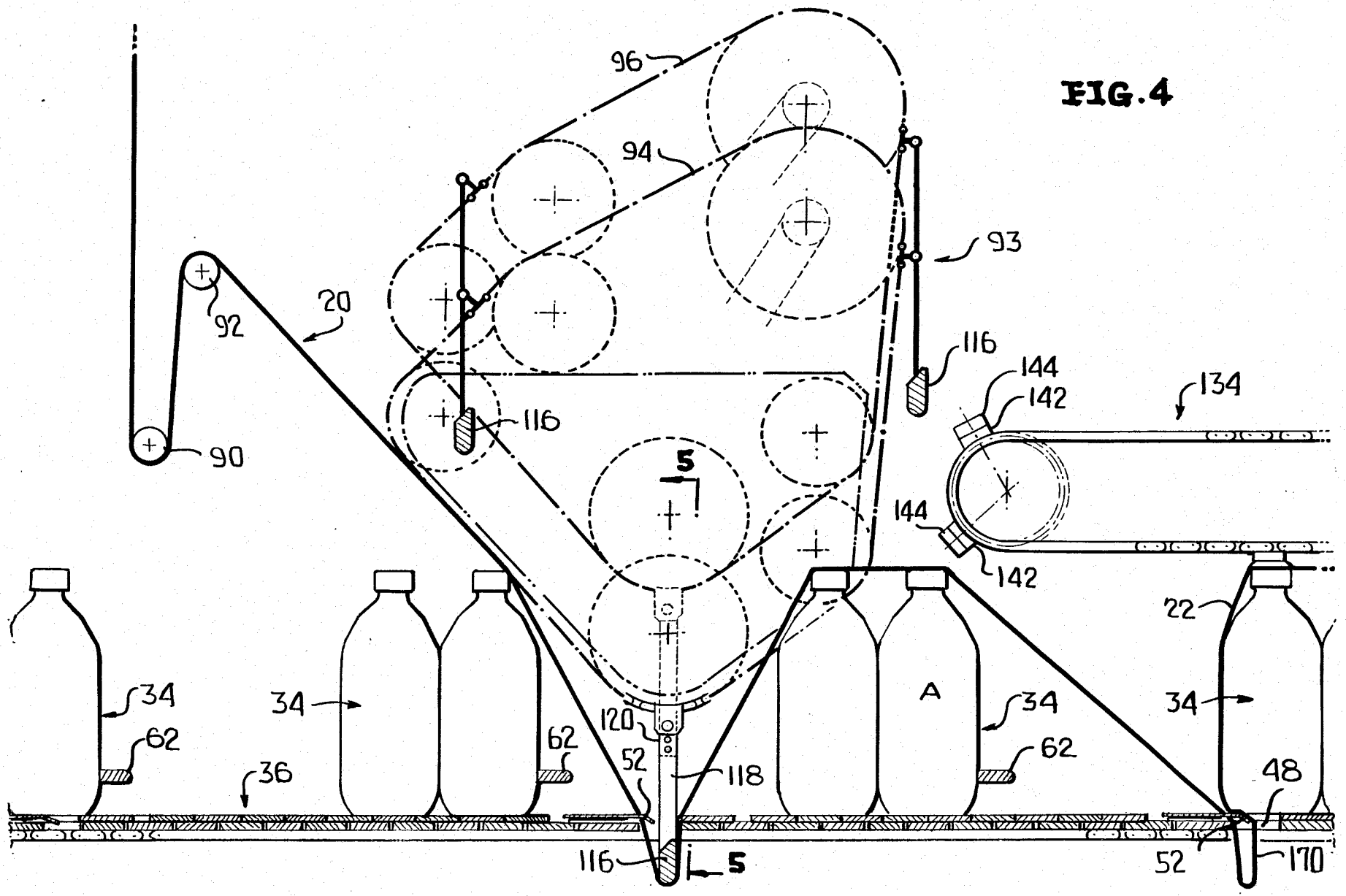
FIG. 4 is an enlarged fragmentary side elevational view similar to FIG. 3 but shows the intermediate portion of the wrap being drawn entirely down through the opening in the conveyor.

Extending transversely of the apparatus between the chains 136 are hold-down bars 142 which in the illustrated embodiment are arranged in pairs for engaging the caps of bottles B when the article cluster 34 is in the form of bottles. As is best shown in FIG. 4, the hold-down bars 142 carry cushion pads 144 which are compressible to provide a positive clamping of the web 20 against the bottle caps.

The apparatus 32 also includes a discharge assembly generally identified by the numeral 146. The discharge assembly 146 is in the form of a plurality of horizontally disposed small diameter rollers 148. As viewed in FIG. 1, a left portion of the rollers 148 are driven while the others are idlers.

At the entrance end of the apparatus, there is a dead plate 150 which receives the article clusters from a cluster forming apparatus which is not part of this invention. The cluster forming apparatus will include a support conveyor 152 and an upper pushing conveyor 154 which carries at regular intervals pushers 156. The pushers 156 serve to push the article clusters 34 from the conveyor 152 onto the dead plate 150 and across the dead plate onto the conveyor 36.

OPERATION

As an article cluster 34 is moved to the right, as shown in FIG. 1 by the conveyor 36, it underlies the web 20. The web 20 is then engaged by a puller bar 116 disposed behind the article cluster as is passes beneath the puller apparatus 93.

As the article cluster proceeds to move to the right, the puller bar 116 descends between the article cluster which it is behind and in front of the next following article cluster 34. Since the conveyor 36 is moving faster than the retarder bars 62, the conveyor 36 is constantly sliding beneath the article clusters.

The respective puller bar 116 continues to descend until it enters an opening 48 between adjacent sections of the conveyor 36. The lowermost position of the puller bar 116 is illustrated in FIG. 4. It is to be understood that the timing of the descent of the puller bar 116 with respect to the movement of the conveyor 36 is such that the puller bar will enter the opening 48 to the position shown in FIG. 4 and will then exit through the opening 48 as shown in FIG. 2 before the opening 48 advances beyond the puller bar. This is due to the carriers for the puller bars passing around the lowermost sprockets 100, 110 and momentarily accelerating the forward advance of the puller bar as will be apparent from FIG. 4.

When the puller bar 116 draws the web 20 through the opening 48, the web is brought immediately in front of the tips 54 of the fingers 52. At this time the tips 54 will be generally aligned with but slightly above the cross bar cuts 28 in the web 20. When the puller bar 116 continues to advance down through the opening 48, and the web 20 is tensioned and drawn more vertically, the fingers 52 will project through the openings defined by the cuts 26, 28 in the manner shown in FIG. 9. This completes the drawing of a wrap 22 for a preceding article cluster 34 and beings the drawing of the wrap 22 for the next trailing article cluster as is clearly shown in FIG. 4. As the trailing article cluster 34 advances relative to the apparatus, it will be seen that the web 20 will be soon engaged by the next following puller bar 116 so as to assume the relationship illustrated in FIG. 1.

Referring once again to FIG. 4, it will be seen that since the conveyor 36 is moving faster than the retarders 62 and thus faster than the article cluster 34, the wrap 20 will be drawn over the top of the article cluster to draw sufficient amount of the individual wrap 22 so as to provide for the wrap extending in front of the article cluster 34 to form a front wall 160 of a resultant completed wrap generally identified by the numeral 162. It will also provide a sufficient amount of the wrap 22 to form a trailing bottom flap 164.

Referring once again to FIG. 4, it will be seen that as the article cluster 34 advances from the position shown in FIG. 4 to the right, the leadingmost articles of the article cluster advance to a position wherein they will be engaged by the cushion pad of one of the hold-down bars 142. When this occurs, the web 20 is firmly clamped to the article cluster and cannot be drawn further over the article cluster. At this time the forward part of the web becomes highly tensioned, with the result that connecting portions 166 (FIG. 7) of the web which extend between the horizontal cuts 28 are tensioned and brought into engagement with a knife element 168 which underlies the fingers 52 as is best shown in FIG. 10. At this time rupture of the web 20 occurs and the forward wrap 22 is separated therefrom.

Again referring ot FIG. 4, it will be seen that the fingers 52 have advanced beneath the next forward article cluster 34 and have drawn a sufficient amount of the wrap 22 in the form of a loop to define a bottom flap portion 170. This bottom flap portion 170 extends through the opening 48 and is now supported by the fingers 52.

Figure 11:
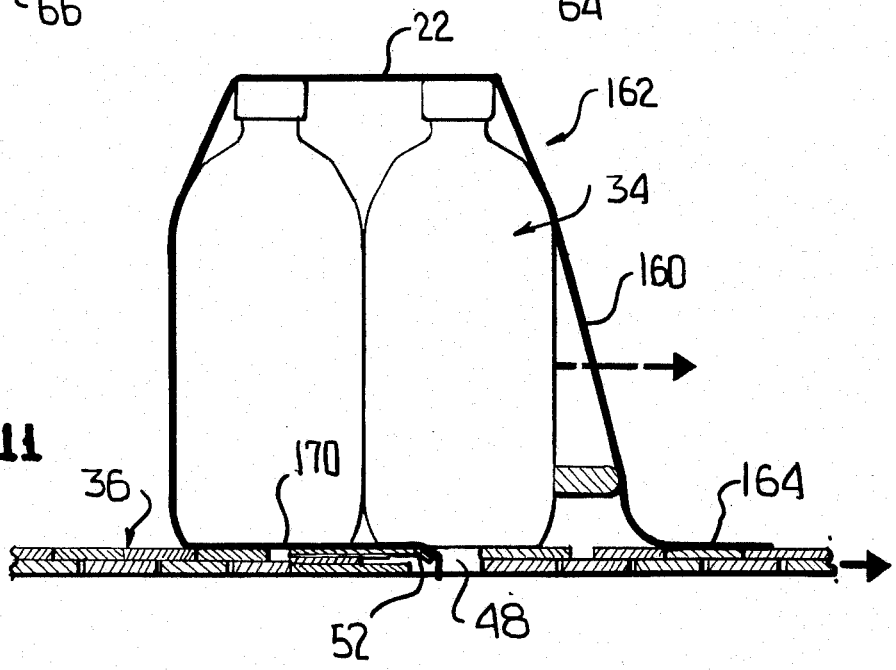
FIG. 11 is an enlarged fragmentary schematic view showing the manner in which the conveyor draws the trailing edge portion of a wrap member beneath an article cluster.

With reference to FIG. 11, it will be seen that as the fingers 52 continue to advance relative to the article cluster 34, the bottom flap 170 will be advanced to completely underlie the article cluster.

Figure 12:
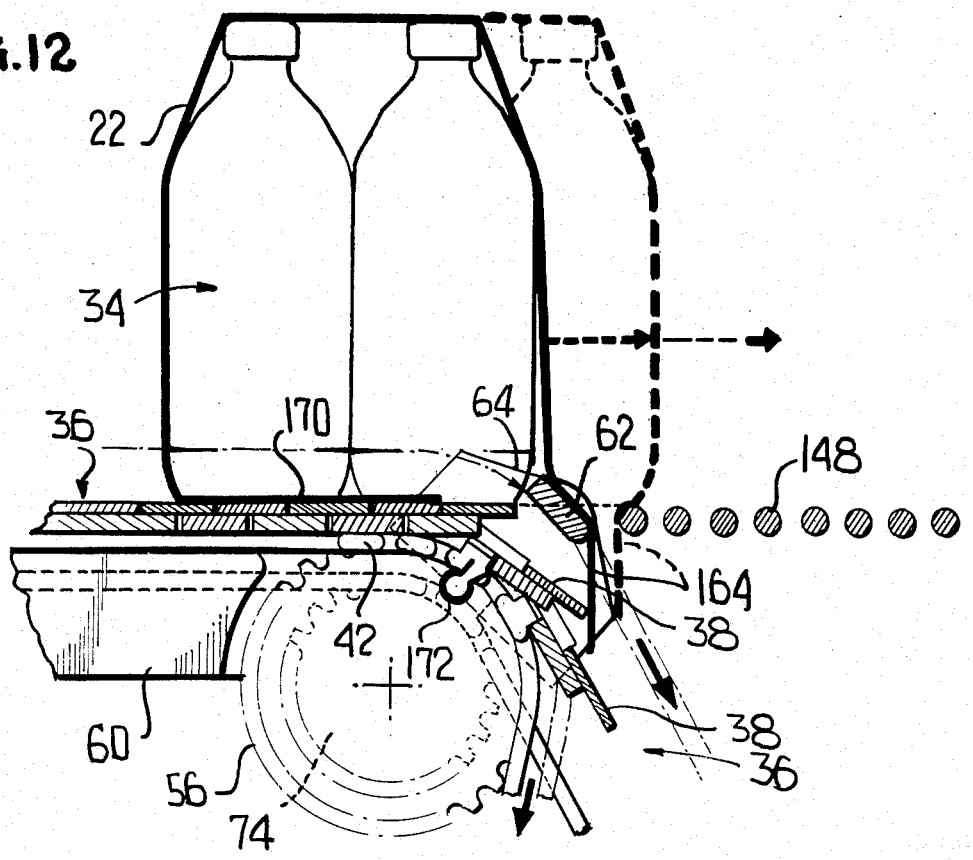
FIG. 12 is an enlarged fragmentary longitudinal sectional view showing the manner in which a partially wrapped article cluster is removed from the conveyor onto discharge rolls.

Referring now to FIG. 12 it will be seen that as the article cluster 34 generally reaches the end of the run of the conveyor 36, the opening 48 has regressed to the point that the flap 164 has dropped through the opening 48.

In FIG. 12, the retarder bar 62 has begun to descend down in front of the rollers 148 and the conveyor 36 has begun to rotate about the sprocket 56.

As the article cluster 34 continues to move to the right, the flap 164 engages a first of the rollers 148 and drawing of the flap 164 rearwardly under the article cluster 34 is initiated. As the flap 170 passes off of the conveyor 36, it is retained against the underside of the article cluster 34 by an airblast from an airblast tube 172 as is clearly shown in FIG. 13.

Figure 13:
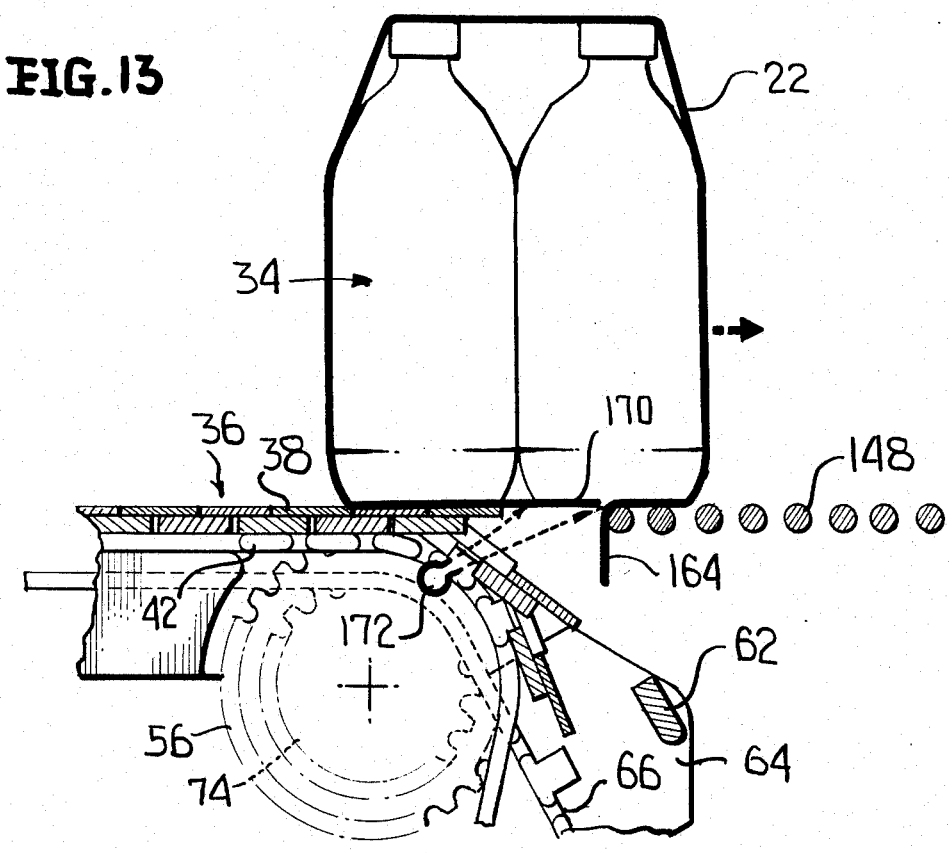
FIG. 13 is an enlarged fragmentary sectional view similar to FIG. 12 and shows the article cluster further advanced onto the discharge rolls and a leading portion of the wrap member being drawn beneath the article cluster.

As the article cluster 34 continues to move to the right, as shown in FIG. 13, the flap 164 is drawn by the rollers 148 beneath the flap 170 to assure a tight package.

When the wrapping of the wrap 22 about the article cluster 34 is completed, the wrapped article cluster moves off of the rollers 148 into a shrink tunnel (not shown) wherein the wrap 22 is heated to first bond the overlapping portions of the flaps 164, 170 and then to effect a shrinking of the wrap 22 about the article cluster 34.

The apparatus as thus described may wrap a single lane of the article clusters 34. However, the width of the conveyor 36 may be such that it will support a plurality of article clusters 34 in transversely aligned relation. Further, such an apparatus may be readily modified to, with reference to bottle pack as the article clusters, form six-packs, eight-packs, twelve-packs, etc. Although the illustrated apparatus also is constructed to wrap only two bottles in the length direction of the apparatus, it will be understood that it is feasible to modify the apparatus to wrap three bottles in the length direction of each article cluster. In addition, it is to be understood that while the article clusters have been illustrated as being formed of bottles, the article clusters 34 may be in the form of cans or may be in the form of single elements which are to be wrapped for packaging.

Although only a preferred embodiment of the invention has been specifically illustrated and described herein, it is to be understood that minor variations may be made in the claims without departing from the spirit and scope of the invention as defined by the appended claims.

I claim:

1. An apparatus for applying a wrap to a cluster of articles in the formation of a package, said apparatus comprising a conveyor for receiving article clusters from a delivery mechanism arranged in spaced relation and delivering wrapped article clusters to a discharge mechanism, said conveyor having at regularly spaced intervals wrap receiving openings extending transversely of a longitudinal direction of movement of said conveyor, said openings being spaced a distance greater than the dimension of an intended cluster in the direction of movement of said conveyor whereby a portion of a wrap may be directed downwardly through each opening, retarder means for engaging and holding back each article cluster conveyed by said conveyor, means for advancing said retarder means in unison with said conveyor but at a slower rate wherein each of said openings after receiving a portion of a wrap progressively passes under a next forward article cluster, and means for supplying an elongated wrap of a length greater than that required to wrap each article cluster, and means for advancing an intermediate portion of such wrap through each of said conveyor openings in sequence.

2. An apparatus according to claim 1 wherein said conveyor at a trailing side of each of said conveyor openings has means for positive interlocking with an associated intermediate wrap portion.

3. An apparatus according to claim 2 wherein said interlocking means in association with the differential speeds of movement of said conveyor and said retarder forms means for advancing a wrap relative to an article cluster.

4. An apparatus according to claim 2 wherein there is a supply of said elongated wrap, and each said preselected length of wrap is defined by a transverse weakening line arrangement for facilitating separation of said wrap into wrap sections of said preselected length.

5. An apparatus and wrap supply according to claim 4 wherein said conveyor at a trailing side of each of said conveyor openings has means for interlocking with an associated wrap portion at said weakening line.

6. An apparatus and wrap supply according to claim 5 wherein said wrap has openings defined therein at said weakening line for positively receiving said interlocking means.

7. An apparatus and wrap supply according to claim 6 wherein each of said wrap openings is defined by a T-shaped cut, each T-shaped cut including a stem extending longitudinally of said wrap and a cross bar extending transversely of said wrap.

8. An apparatus and wrap supply according to claim 7 wherein all wrap openings of a preselected length of wrap are in transverse alignment with said cross bars being in a line and defining said transverse weakening line, said cross bars having ends spaced from ends of adjacent transversely aligned cross bars.

9. An apparatus and wrap supply according to claim 6 wherein downstream of said means for supplying an elongated wrap there are clamp means for clamping an intermediate part of a wrap section to a respective article cluster whereby advance of said interlocking means with said wrap relative to said wrap clamped intermediate part form means for rupturing said wrap along said weakening line.

10. An apparatus according to claim 1 wherein said conveyor and said retarder means have an effective run wherein article clusters are seated on said conveyor, and the length of said run and the relative speeds of said conveyor and said retarder means are such that a conveyor opening positioned rearwardly of a preceding retarder means for receiving a wrap portion between two article clusters will advance at least to said preceding retarder means during movement along said run.

11. An apparatus according to claim 1 wherein said means for supplying an elongated such wrap includes means for positively supplying a preselected length of wrap for each article cluster.

12. An apparatus according to claim 1 wherein said means for advancing a wrap portion through each conveyor opening includes puller bars mounted for movement about a predetermined path of which a portion is through a conveyor opening and return in timed relation to movement of said conveyor.

13. An apparatus for applying a wrap to a cluster of articles in the formation of a package, said apparatus comprising a conveyor for receiving article clusters from a delivery mechanism arranged in spaced relation and delivering wrapped article clusters to a discharge mechanism, said conveyor having a regularly spaced intervals wrap receiving openings extending transversely of a longitudinal direction of movement of said conveyor, said openings being spaced a distance greater than the dimension of an intended cluster in the direction of movement of said conveyor whereby a portion of a wrap may be directed downwardly through each opening, retarder means for engaging and holding back each article cluster conveyed by said conveyor, means for advancing said retarder means in unison with said conveyor but at a slower rate wherein each of said openings after receiving a portion of a wrap progressively passes under a next forward article cluster, and means for supplying an elongated wrap and means for advancing a wrap portion through each of said conveyor openings in sequence, said conveyor at a trailing side of each of said conveyor openings having means for interlocking with an associated wrap portion, said interlocking means in association with the differential speeds of movement of said conveyor and said retarder forming means for advancing a wrap relative to an article cluster, and means for transversely rupturing said wrap into an individual wrap section when the wrap is held relative to an article cluster.

14. An apparatus according to claim 13 wherein downstream of said means for supplying an elongated wrap there are clamp means for clamping an intermediate part of a wrap section to a respective article cluster.

15. A method of applying a wrap to an article cluster, said method comprising the steps of providing an endless conveyor having at spaced longitudinal intervals transverse openings, seating an article cluster on said conveyor between each pair of adjacent conveyor openings, applying a continuous wrap in overlying relation to each article cluster, drawing the wrap down into each conveyor opening, interlockingly engaging the wrap with the conveyor at a trailing side of each conveyor opening, thereafter holding the wrap relative to an article cluster and utilizing the conveyor to separate the wrap into a wrap member for the respective article cluster, and utilizing the conveyor to draw a trailing portion of each wrap member forwardly under a respective article cluster as a wrap bottom flap.

16. A method according to claim 15 wherein a retarder is positioned in advance of each article cluster, and the retarders are moved at a lesser speed than the conveyor whereby the conveyor moves under and relative to each article cluster to first draw the wrap forward relative to a trailing article cluster, then to effect said separation of the wrap when the wrap is held relative to the trailing article cluster, and thereafter to effect said drawing forwardly of the trailing portion.

17. A method according to claim 16 wherein said holding of the wrap relative to an article cluster is effected by an overhead moving clamp apparatus which is moved at the same rate as the retarders.

18. A method according to claim 15 wherein said holding of the wrap relative to an article cluster is effected by an overhead moving clamp apparatus.

19. A method according to claim 15 wherein the wrap supplied is divided into wrap members by transverse weakening lines along which said wrap separation is effected.

20. A method according to claim 15 wherein the wrap supplied is divided into wrap members by transverse weakening lines along which said wrap separation is effected, and wherein at each transverse weakening line and to the rear of each transverse weakening line are openings for receiving portions of the conveyor to effect said interlocking engagement of the wrap with the conveyor.

* * * * *